US006022010A

United States Patent [19]

Bernstein

[11] Patent Number: 6,022,010

[45] Date of Patent: Feb. 8, 2000

[54] QUICK CHANGE JAW PLATE

[75] Inventor: Leon M. Bernstein, Minnetonka, Minn.

[73] Assignee: Kurt Manufacturing Company, Inc., Fridley, Minn.

[21] Appl. No.: 08/893,795

[22] Filed: Jul. 11, 1997

[51] Int. Cl.[7] ..... B25B 1/24

[52] U.S. Cl. ..... 269/279; 269/280; 269/283

[58] Field of Search ..... 269/282, 279, 269/280, 283, 284, 309

[56] References Cited

U.S. PATENT DOCUMENTS

| | | | |
|---|---|---|---|
| 4,098,500 | 7/1978 | Lenz | 269/136 |
| 4,291,870 | 9/1981 | Warde | 269/279 |
| 4,437,654 | 3/1984 | Chiappetti | 269/283 |
| 4,861,010 | 8/1989 | Neil | 269/282 |
| 4,898,371 | 2/1990 | Mills et al. | 269/136 |
| 5,078,372 | 1/1992 | Fitzpatrick | 269/282 |
| 5,242,159 | 9/1993 | Bernstein | 269/32 |

*Primary Examiner*—David A. Scherbel
*Assistant Examiner*—Benjamin M. Halpern
*Attorney, Agent, or Firm*—Westman, Champlin & Kelly, P.A.

[57] ABSTRACT

A removable quick change jaw plate for a vise has a T-slot that receives a pull rod that extends into a bore formed in the vise. The pull rod is actuated to pull the jaw toward the vise. A wedge clamp, actuated by a threaded element provides a clamping motion to hold the jaw plate on the vise.

23 Claims, 11 Drawing Sheets

QUICK CHANGE JAW PLATE

BACKGROUND OF THE INVENTION

The present invention pertains to a quick change vise jaw plate for a clamping system that is releasably secured and tightened on fixed or moveable jaws efficiently and securely.

The field of quick change vise jaws plates has been developing because there has been a greater emphasis on having "sculptured" jaws that will fit particular work pieces that are to be held for machining or the like. Removable jaw plates are provided in U.S. Pat. No. 4,898,371, and are held in position with headed screws or "T"-shaped clamps, but the ability to quickly change a jaw is a problem. Patent '371 does eliminate the need for bolts that are inserted through the gripping surface of the jaw.

U.S. Pat. No. 5,078,312 shows a quick change vise jaw that utilizes key hole slots, but bores or openings on the jaw faces are required in the form shown.

The ability to change jaws quickly is particularly important where a soft, sculptured jaw is being used.

SUMMARY OF THE INVENTION

The present invention relates to a jaw plate that is removably mounted on a clamp, such as a vise, and can be interchanged with other jaw plates. The jaw plates are locked in position with a lock that is accessible without having to provide access for a wrench between the jaws, which requires extra opening. The jaw plates provide jaw faces that can be adapted to particular work pieces and can be quickly changed when different work pieces are to be machined and held in the clamp jaws. The jaw plate shown can be used on any type of clamp, as well as on vise jaws. It is held securely with the present devices without having bores in the jaw face which engage the work piece, to eliminate one of the problems with previous jaws. Additionally, the ability to clamp the jaw plate tightly onto the jaw of the vise or clamp is enhanced by the present unit that utilizes a wedge lock arrangement that pulls a pull rod that has a head in a "T" slot on the jaw plate to clamp the jaw plate tightly against the vise.

The jaw plates of the present invention can be adapted to be used with any type of clamp, including single-acting or single-jaw vises, and vises that have two lockable jaws operated together. The overall configuration is compact, easily made and installed, and permits quick removal and replacement of jaw plates without disassembly of the fasteners.

Advantages include having a linear locking force on the jaw plate in relation to the torque in the screw or opposed to an eccentric lock, which adds a lateral load. The two wedge lock members used cause sliding of the pull rod to tighten the jaw plate without friction caused by lateral loads.

DETAILED DESCRIPTION OF THE PREFERRED EMBODIMENTS

Figure 1:
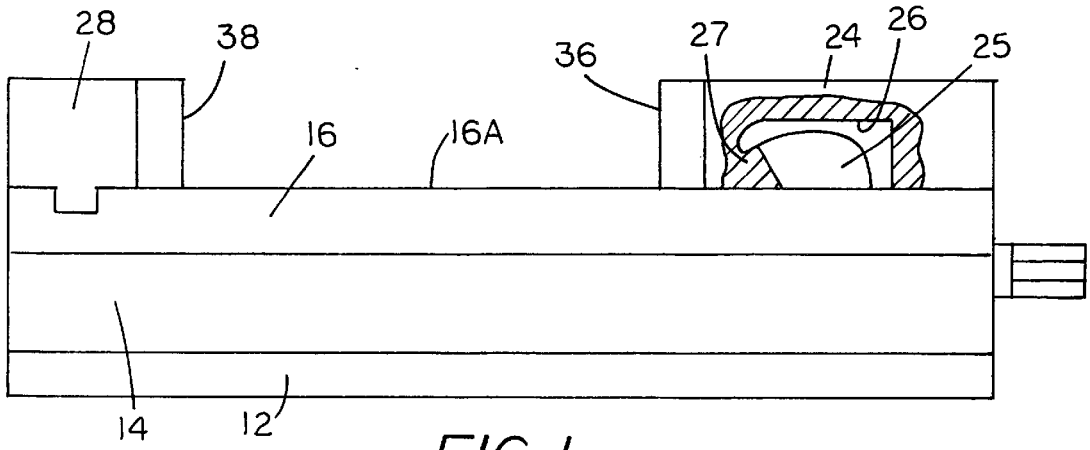
FIG. 1 is a side elevational view of a typical vise having jaw plates installed hereon, made according to the present invention.
Figure 2:
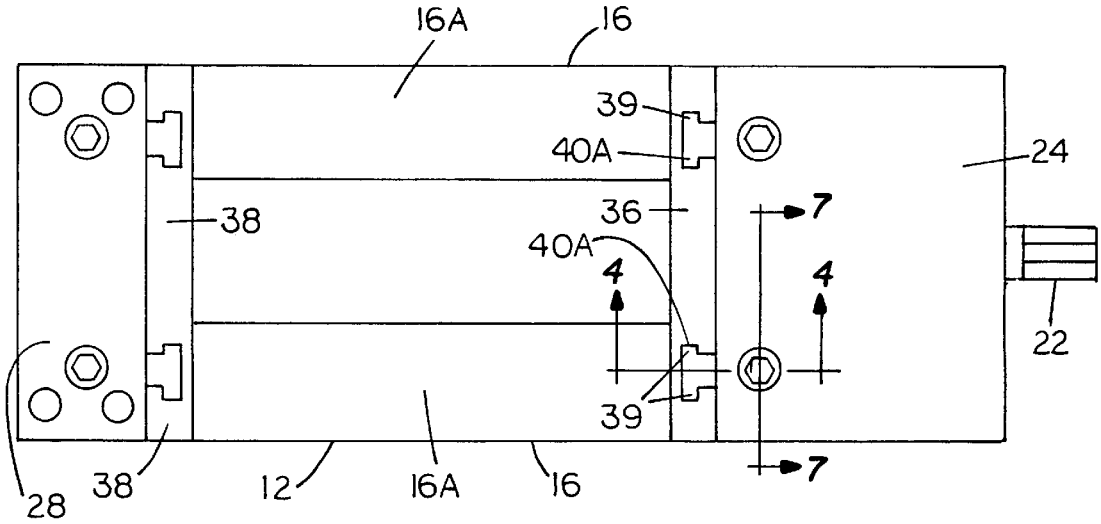
FIG. 2 is a top plan view of the vise in FIG. 1.
Figure 3:
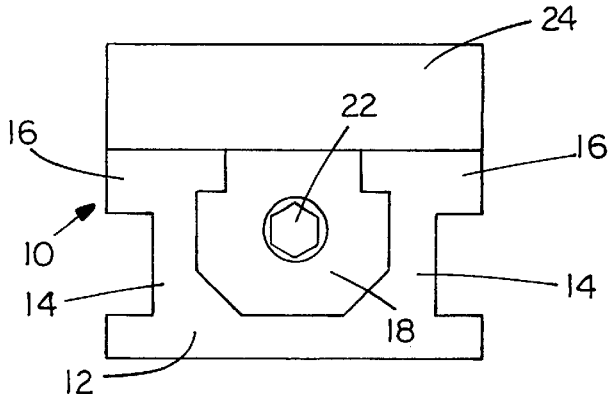
FIG. 3 is an end view of the vise in FIG. 1.

A machine vise 10 shown in FIGS. 1, 2, and 3 has body 11 with a base plate 12 and upstanding side walls 14 supporting rail portions 16 at the upper ends. The rail portions 16 are spaced apart to define a slot for movement of a vise jaw nut shown in FIG. 3 at 18. The nut can be moved longitudinally along the central axis of a vise screw 22, and the nut is arranged to drive a moveable jaw 24. The vise jaw nut arid jaw can be made, for example, as shown in U.S. Pat. No. 4, 098,500.

As shown schematically in FIG. 1, the vise jaw nut has a head portion 25, which extends into a recess 26 in the moveable jaw 24, and reacts against a tapered wall 27 for driving the nut toward a fixed jaw 28. The fixed jaw 28 is secured on the top rails 16, and the moveable jaw slides along the surfaces 16A of the top of rails 16.

Figure 5:
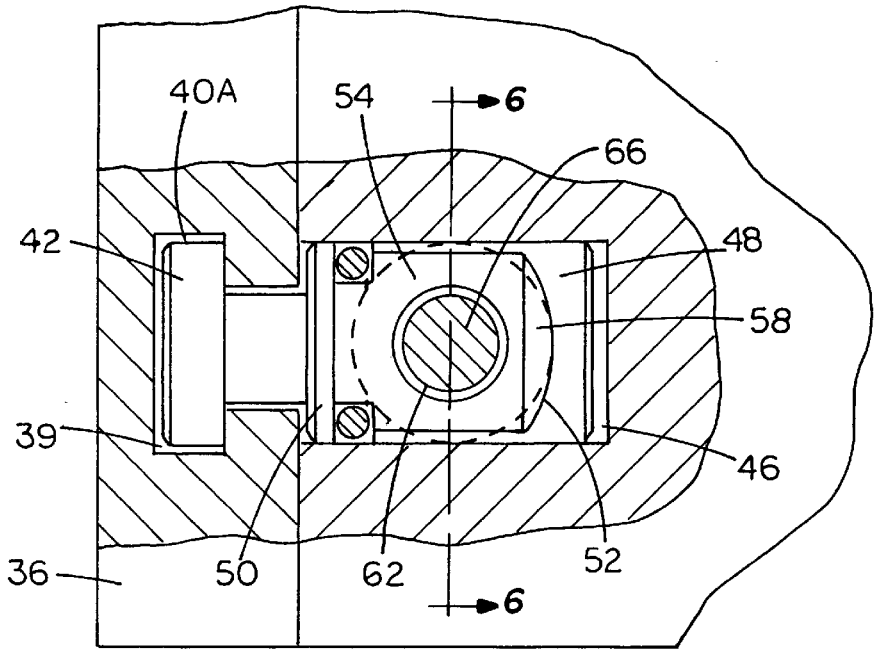
FIG. 5 is a sectional view taken generally along line 5—5 in FIG. 4.
Figure 6:
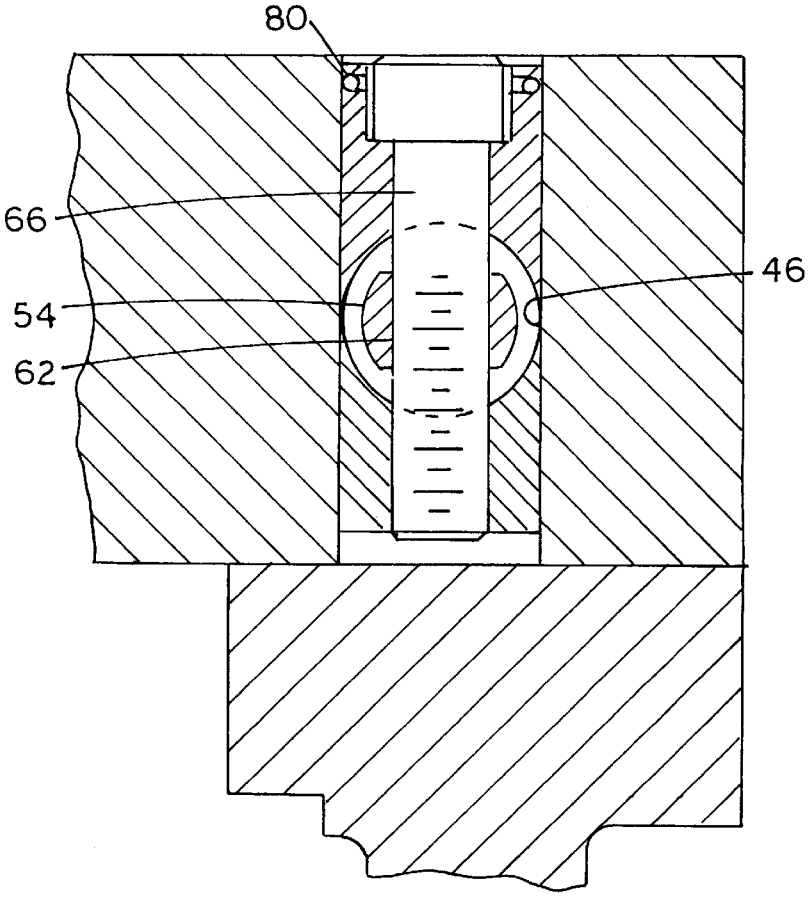
FIG. 6 is a sectional view taken as on line 6—6 in FIG. 5.

The moveable jaw 26 and the fixed jaw 28 each have an interchangeable quick change jaw plate 36 and 38 mounted thereon. The mounting structure is shown in greater detail in FIGS. 4–8; and in FIGS. 4, 5, and 6, the mounting of the jaw plate 36 is illustrated.

Figure 4:
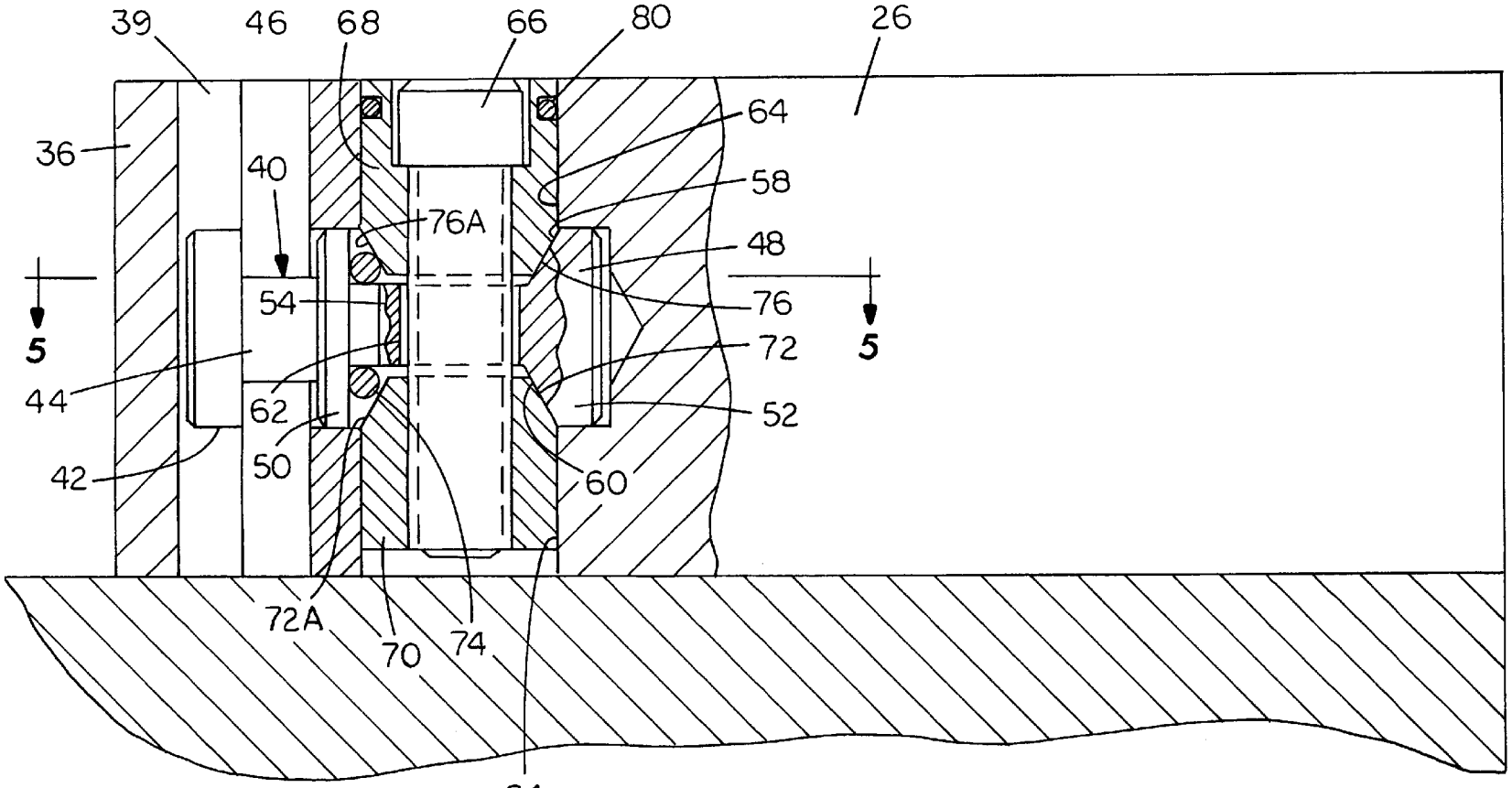
FIG. 4 is a sectional view taken generally along line 4—4 in FIG. 2.
Figure 7:
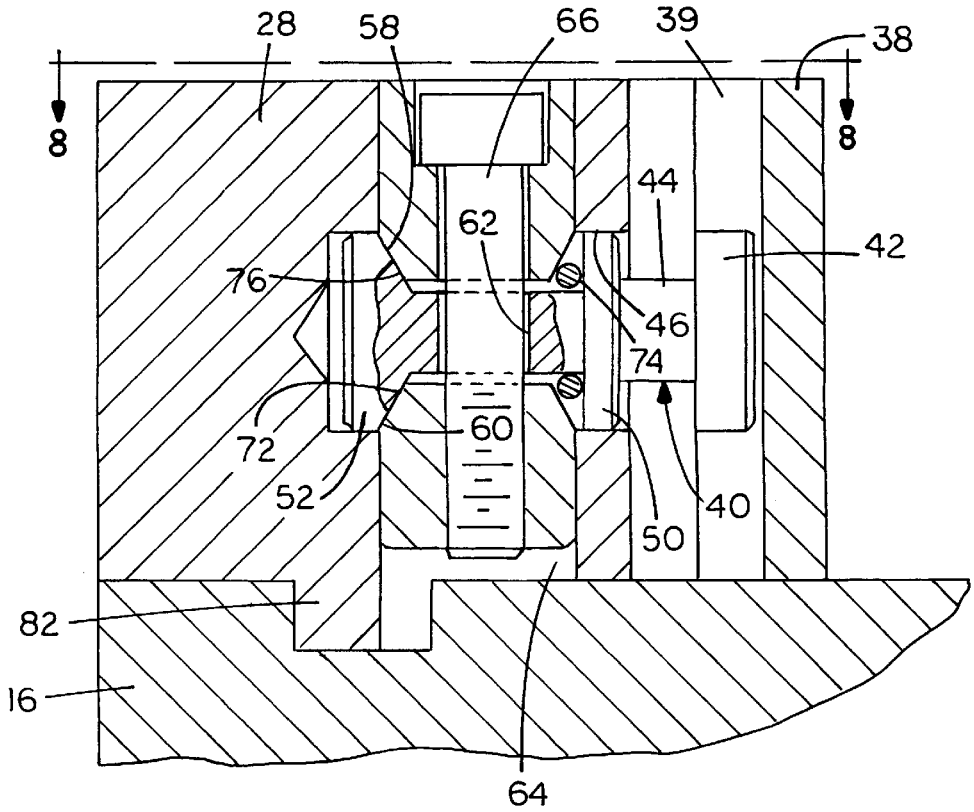
FIG. 7 is a sectional view taken as on line 7—7 in FIG. 2.

As shown in FIG. 2, the jaw plate 36 has a pair of "T"-shaped cross-section vertical slots 39 at opposite ends thereof which are used for securing the jaw plate 36 to a face of the moveable jaw 24. The securing devices are wedge lock-operated pull rods 40, as shown. The wedge lock pull rods 40 include a head 42 that fits into the wide portion 40A of the "T"-shaped slot 39, and a shank portion 44 that fits through the narrow neck portion of the "T"-shaped slot. The wedge lock pull rods 40 extend into a bore 46 shown in FIGS. 5 and 6 formed in jaw 26. The bore 46 is a blind bore that ends without passing all the way through the moveable jaw 26 and is of size to receive an wedge collar 48 of the wedge lock pull rod 40. A "land" or guide collar 50 is formed on the pull rod 40, and the guide collar 50 slidably fits within the bore 46 near the face of the jaw. A wedge lock end 52 of the pull rod that has a part cylindrical outer surface is slidably mounted at the inner end of the bore 46. Between the guide collar 50 and the wedge lock end 52, flat surfaces 53 are formed on the pull rod 40 on each side to provide a center section 54. A pair of oppositely-facing, planar transverse wedge surfaces 58 and 60 are formed on the wedge lock end 52, and they taper to and join the flat surfaces 53 in center section 54. The wedge surfaces 58 and 60 extend at a taper relative to the axis of the pull rods at the inner end of the center section 54. The flat surfaces 53 extend back to the land or guide collar 50, as seen in FIGS. 4 and 7. The cross-sectional shape of center section 54 are perhaps best seen in FIG. 6. The tapered, planar wedge surfaces 58 and 60 face up and down and taper away from the surfaces 53 toward the outer end portion 52 of the pull rod 40. The pull rods are wedge-actuated fasteners.

A vertical cross bore 64 is formed in the jaw 26 with an axis perpendicular to and intersecting the axis of the bore 46. The center section 54 of the pull rod 40 has a bore or opening 62 formed therein, (see FIG. 4) which is of size to receive a wedge lock or a cap screw 66. The bore 64 has a pair of wedge lock actuator members slidably mounted therein on opposite sides of the center section 54 of pull rod 40. The wedge lock actuator members 68 and 70 have cylindrical outer surfaces that fit into the bore 64. The wedge lock actuator 68 has a central opening for receiving the cap screw 66. The wedge lock actuator member 70 in a bottom portion of the bore 64 has a threaded opening in the center into which the cap screw 66 threads. The end of actuator 70 has a tapered wedge end surface 72 that mates with the wedge surface 60 on pull rod 40. The actuator 70 It also has a tapered wedge surfaces 72A that is on the opposite side of the actuator member from surface 72, but which does not engage a wedge surface on the pull rod 40. Instead, the surface 72A engages an O-ring 74 that is positioned against the guide collar 50.

The wedge lock actuator member 68 is slidably mounted on the upper side of bore 64. The end of wedge lock actuator member 68 has a tapered wedge surface 76, which mates with the wedge surface 58 on the wedge lock end of the pull rod 40, and has another oppositely-facing wedge surface 76A that also engages the O-ring 74 adjacent to the guide collar 50 on the pull rod 40.

The cap screw 66 is positioned in a counter bore on the wedge lock actuator member 68. The bore in wedge lock actuator member 68 forms a shoulder that supports the head of the cap screw 68. The cap screw 66 passes through the bore or opening 62 in the pull rod 40, with clearance and threads into provided internal threads in a bore on the lower wedge lock actuator member 70. The wedge lock actuator member 68 has an O-ring seal 80 at an upper end thereof to prevent chips from entering the bore 64.

By tightening the cap screw 66, the wedge lock actuator member 70 is drawn upwardly, and the wedge lock actuator member 68 is forced downwardly, thereby balancing the upward force. The wedge surfaces 72 and 76 act against the wedge surfaces 58 and 60 and urge the pull rod 40 inward toward the closed end of the bore 46 toward so that the head 42 of the pull rod moves toward the face 48 of moveable jaw 26. The head 42 of the pull rod 40 in the "T"-shaped slot 38 will draw the jaw plate 36 tightly against the face 48 of the jaw 26.

The bore 64 can be slightly larger than the wedge lock actuator members 68 and 70 so that the wedge lock actuator members slide easily. It can be seen that the wedge lock actuator members 68 and 70 are drawn together by tightening pull rod 66. The actuators provide the axial force on the pull rod 40 to tighten the jaw plate 36 against the face 48 of the moveable jaw 26 by acting through the wedge surfaces. The O-ring 74 will be compressed as the pull rod 66 is tightened, and the compression force will provide an outward force on the head 42 and the pull rod 40 when the wedge lock actuator members 68 and 70 are released from surfaces 58 and 60 by reversing the cap screw 66.

The present invention provides a very quick way of installing a jaw plate because the T-slots 39 of jaw plate 36 permit the heads 42 of the two pull rods 40 to slide into position easily. The T-slots 39 extend for the full vertical height of the jaw plate 36. A new jaw plate having T-slots of the same size and spacing can then be quickly inserted and tightened down by tightening the cap screws 66. Since there are no bores open on the clamping surface of the jaw plate 36, the jaw plate can be sculptured or machined to fit a particular work piece as desired.

The jaw plate 38 for the fixed jaw 28 can be secured in exactly the same manner. As shown in FIG. 7, the fixed jaw 28 has a rib 82 that fits into slots on the rails 16 of the vise, and the fixed jaw is then held in place with suitable cap screws 84 threaded into the rails.

Figure 8:
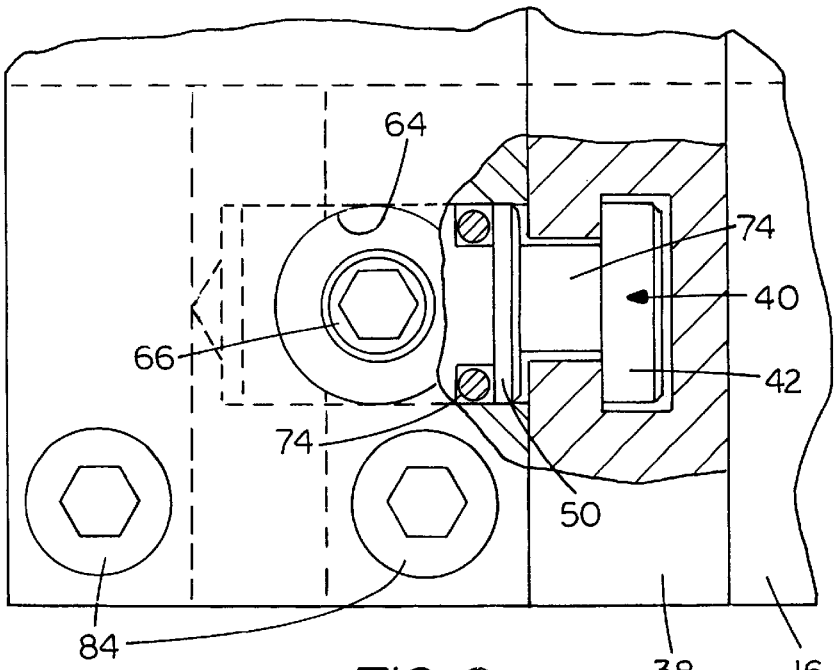
FIG. 8 is a sectional view taken along line 8—8 in FIG. 7 with parts broken away.

The assembly of the wedge lock actuator members and the pull rods 40 are exactly the same for the jaw plate 38 and fixed jaw 28. The T-slots 86 in the jaw plate 38 are constructed the same, as well. FIG. 8 is a top view which shows the top of the cap screw 66, along with a straight guide collar 50 on the pull rod 40.

All of the other parts are the same for the pull rod and wedge lock assembly.

Figure 9:
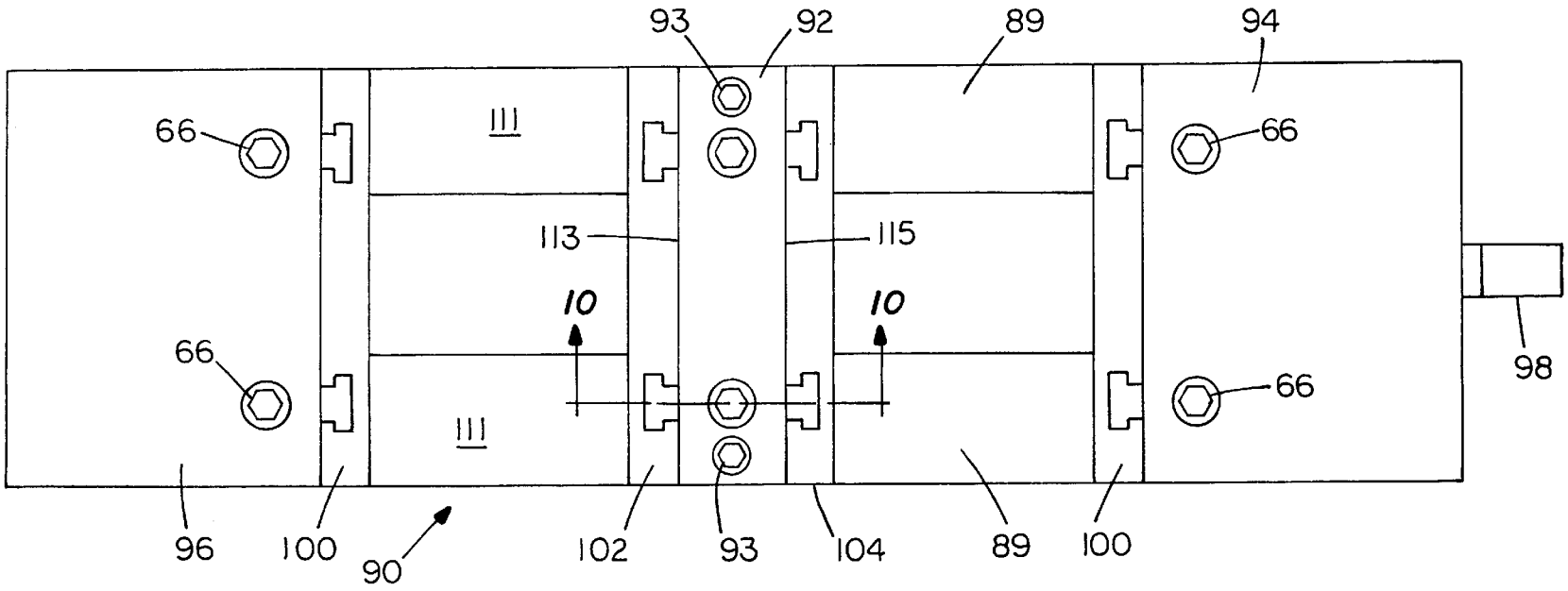
FIG. 9 is a top plan view of a modified vise on which the quick change jaw plates of the present invention are installed.

In FIG. 9, a modified vise 90, as shown, is a double moveable jaw vise. The vise 90 has a center fixed jaw 92 and first and second moveable jaws 94 and 96, respectively, which are moved with a screw 98.

A vise of this type is shown in U.S. Pat. No. 4,934,674. The locking assemblies for the jaw plates shown at 100 for the moveable jaws of vise 90 are the same as those shown in the previous form of the invention, but the mounting for the jaw plates 102 and 104 on opposite sides of the fixed jaw 92 are modified slightly. The same wedge lock operation for locking headed pull rods in T-slots provided on the jaw plates 102 and 104 are used. The fixed jaw 92 is seated in a recess 91 (FIG. 10) in the vise rails 89 ard held in place with cap screws 93.

Figure 10:
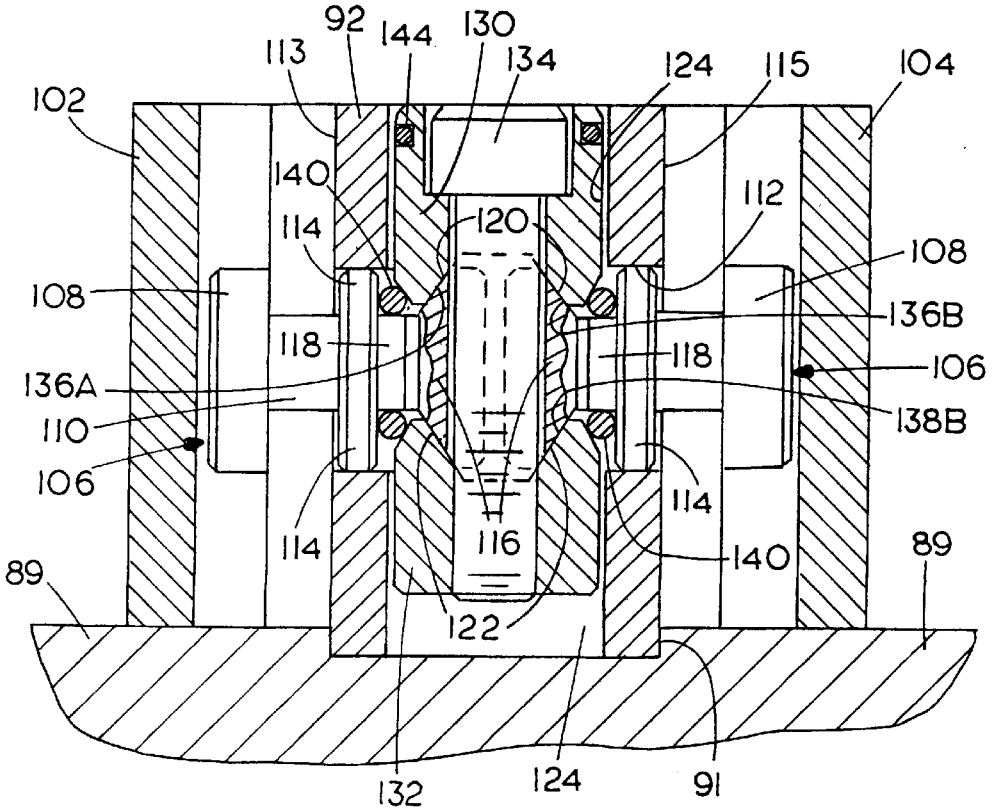
FIG. 10 is a sectional view taken as on line 10—10 in FIG. 9.
Figure 11:
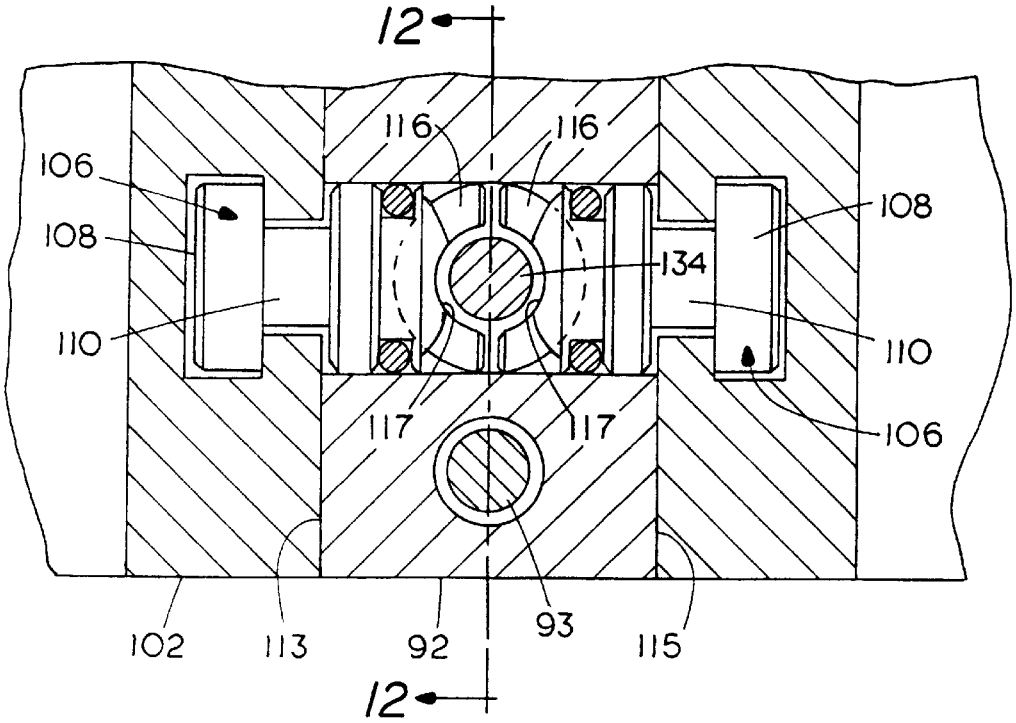
FIG. 11 is a sectional view taken as on line 11—11 in FIG. 10.
Figure 12:
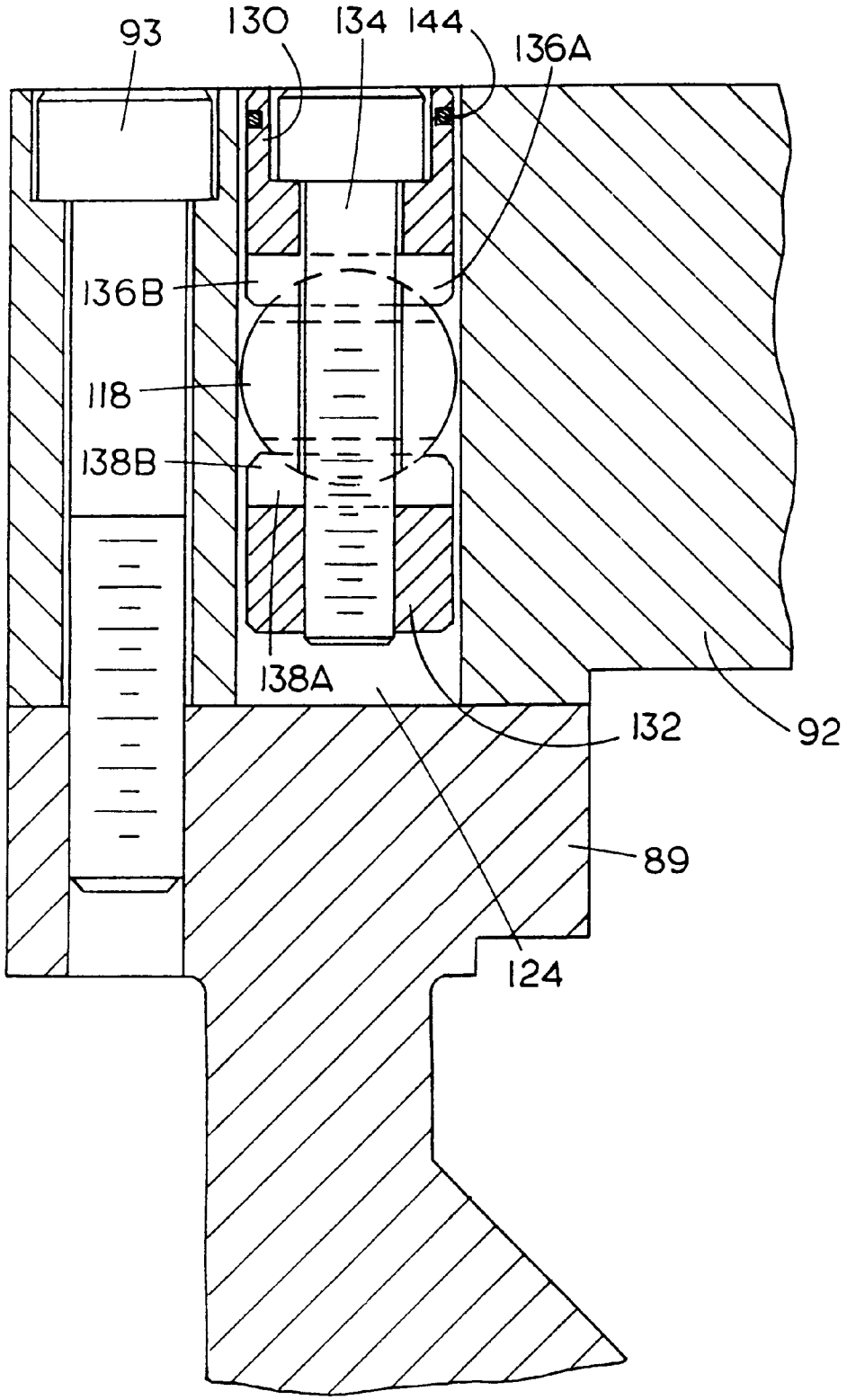
FIG. 12 is a sectional view taken as on line 12—12 in FIG. 11.

As shown in FIGS. 10, 11, and 12, the jaw plates 102 and 104 are each held in place with a separate pull rod or wedge lock actuated fastener 106. The pull rods 106 are simultaneously loaded by wedge lock actuator members, as will be shown. Pull rods 106 have heads 108, with a shank portion 110 that passes through the narrow slot opening of the T-slots 99.

Two laterally spaced bores 112 are provided through the fixed jaw 92. Each of the bores 112 is sized to receive wedge lock end of two of the pull rods 106, with the pull rod heads 108 extending out from opposite faces 113 and 115 of fixed jaw 92. Straight guide collar portions 114 of the pull rods 106 are positioned in the bores 112 adjacent to the fixed jaw faces 113 and 115.

The wedge lock wedge ends 116 of the pull rods 106 are quite short compared to the first form of the invention and have a short, flattened shank section 118 formed by recesses on the top and bottom of the pull rod and by wedge surfaces 120 and 122. The wedge surfaces 120 and 122 on one pull rod 106 face in direction toward surface 113, and the wedge surfaces 120 and 122 on the other pull rod 106 face in opposite direction toward surface 115. The wedge ends 116 of the pull rods protrude into a cross bore 124 that extends vertically through the jaw 92. The center lines of the bore 124 and the bore 112 intersect. The end surfaces of wedge collars 116 of the pull rods 106 have part-cylindrical recesses therein much like a half of a cylindrical hole, as can perhaps best be seen in FIG. 11 at 117. The bore 124 houses a pair of wedge lock actuator members 130 and 132 and the wedge lock actuator member 130 has a countersunk center bore for receiving a cap screw 134. With clearance, the cap screw 134 has a head that seats in the shouldered counter sunk recess of the bore through wedge lock actuator member 130. The cap screw 134 fits into the part-cylindrical openings 117 of the end surfaces of wedge lock ends 116 of the pull rods 106 and threads into a threaded bore in the wedge lock actuator member 132. In this form of the invention, the wedge lock actuator members 130 and 132 have facing wedge surfaces 136A and 136B, and 138A and 138B that are formed on the interior of the bores through the wedge lock actuator members 130 and 132. These wedge surfaces 136A, 136B, 138A, and 138B engage the aligned wedge surfaces 120 and 122 on the wedge lock portions 116 of the pull rods 106.

O-rings 140 are positioned between the straight guide collars 114 and the respective wedge lock actuator members 130 and 132 for providing compressive forces to urge the heads 108 outwardly from the center jaw 92 when the wedge lock actuator members 130 and 132 are released. The wedge lock actuator member 130 has an end O-ring 144 for preventing chips from entering the bore 124.

The bore 124 is made slightly oversized so that the wedge lock actuator members 130 and 132 can "float" for tolerance allowance between the surfaces that are engaged by the heads 108 and the mating surfaces of the jaw plates and the fixed jaw 92.

It can be seen that upon tightening the cap screw 134, the wedge lock actuator members 130 and 132 will be drawn together and the cam surfaces 136A, 136B, 138A, and 138B will engage the cam surfaces 120 and 122 on the wedge lock end members 116 of the pull rods 106. This will pull the two wedge lock actuator members together and force the heads 108 of pull rods 106 toward the fixed jaw 92 to clamp both of the jaw plates 102 and 104 tightly against the opposite side faces 113 and 115 of the fixed jaw 92.

As stated, the moveable jaws 94 and 96 have jaw plates 100 that are attached as shown in the previous form of the invention. The advantages of this quick attach jaw plate system are achieved with the double locking vise and the unique arrangement for providing a double wedge lock that will self-center and permit clamping the vise jaw plates against the fixed jaw 92 to ensure that the jaw plates are held securely.

Figure 13:
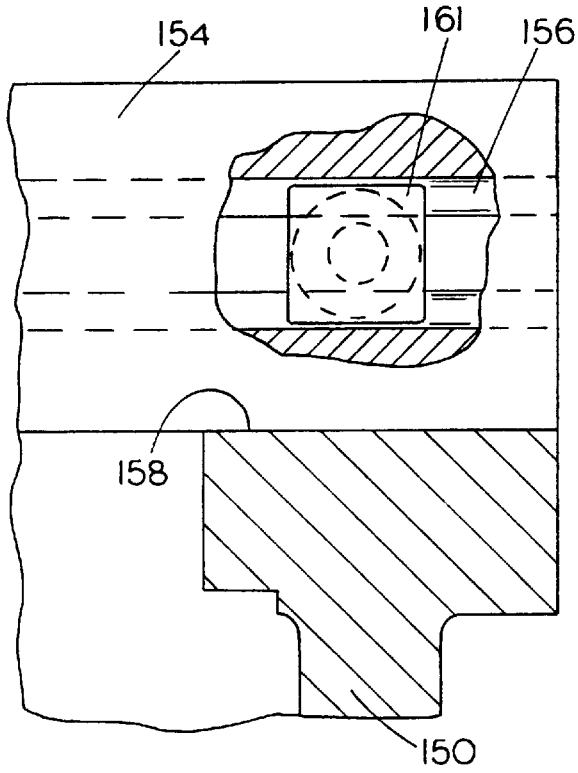
FIG. 13 is a fragmentary front view of a further modified jaw plate embodying the present invention.
Figure 14:
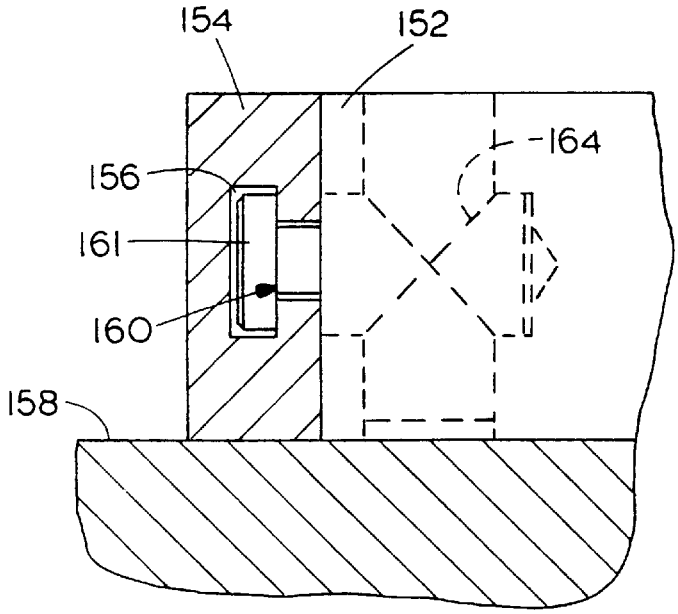
FIG. 14 is a side view of the device of FIG. 13 with parts broken away.

FIGS. 13 and 14 illustrate a modified form of the pull rod utilized with the present invention. Referring specifically to FIGS. 13 and 14, a vise body 150 can be formed as shown in the previous forms of the invention, and the vise body will mount a jaw 152 as previously shown. Jaw 152 could either be a fixed jaw or a moveable jaw, as desired. The vise jaw 152 has a jaw plate 154 mounted thereon. In this form of the invention, two variations are shown. The vise jaw plate 154 has a T-slot 156 formed therein which extend horizontally, that is, parallel to the plane of the rail surfaces shown at 158.

Additionally, a pull rod or wedge lock actuated fastener having wedge lock surfaces as explained in the previous forms of the invention is shown at 160. Pull rod 160 has a square head 161, which is also shown in FIG. 13. The square head 161 fits into the T-slot 156. The jaw 152 has a wedge lock actuator assembly 164 which is made as in the previous form of the invention and serves to pull the head 161 of pull rod 160 toward the jaw 152 to pull the jaw plate 154 tightly against the jaw surface in the same manner as previously described.

The head 161 has four corners to clamp onto surfaces of the T-slot, and it serves to clamp the jaw plate tightly against the jaw surface as previously explained.

Figure 15:
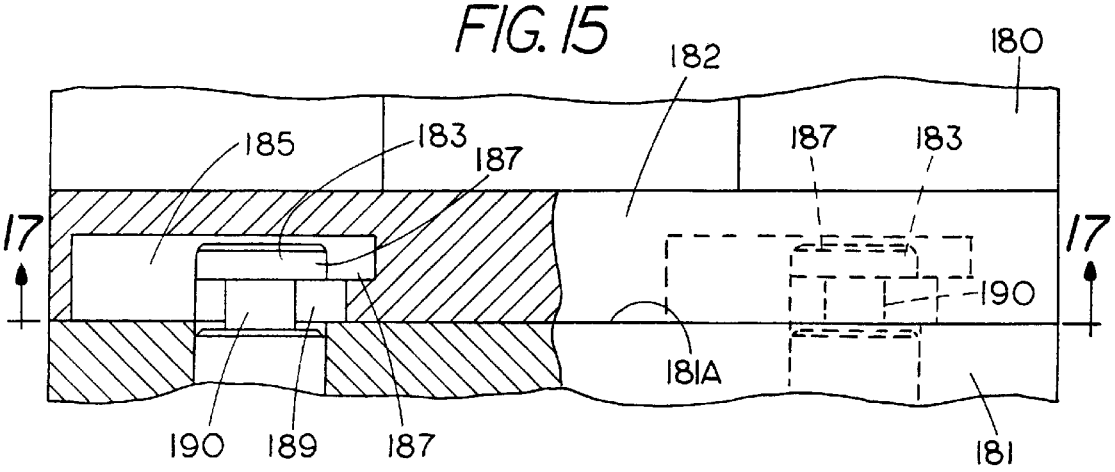
FIG. 15 is a top view of a modified jaw plate made according to the present invention with parts broken away in parts in section.
Figure 16:
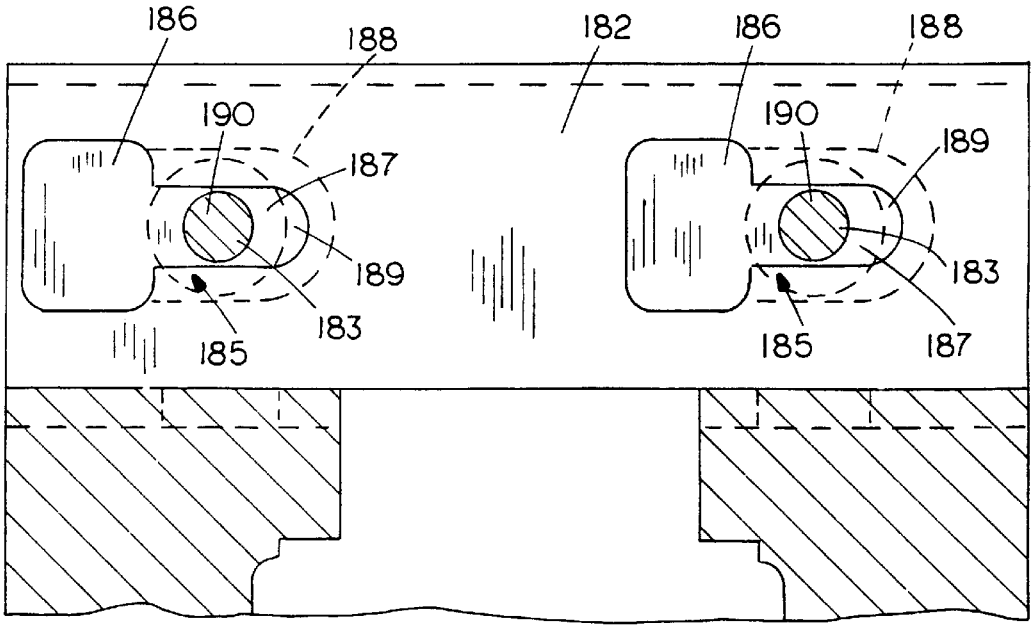
FIG. 16 is a sectional view taken as on line 16—16 in FIG. 15.

In FIGS. 15 and 16, a vise indicated at 180 has a jaw 181 that is shown only fragmentarily, on which a jaw plate 182 is to be mounted.

Figure 17:
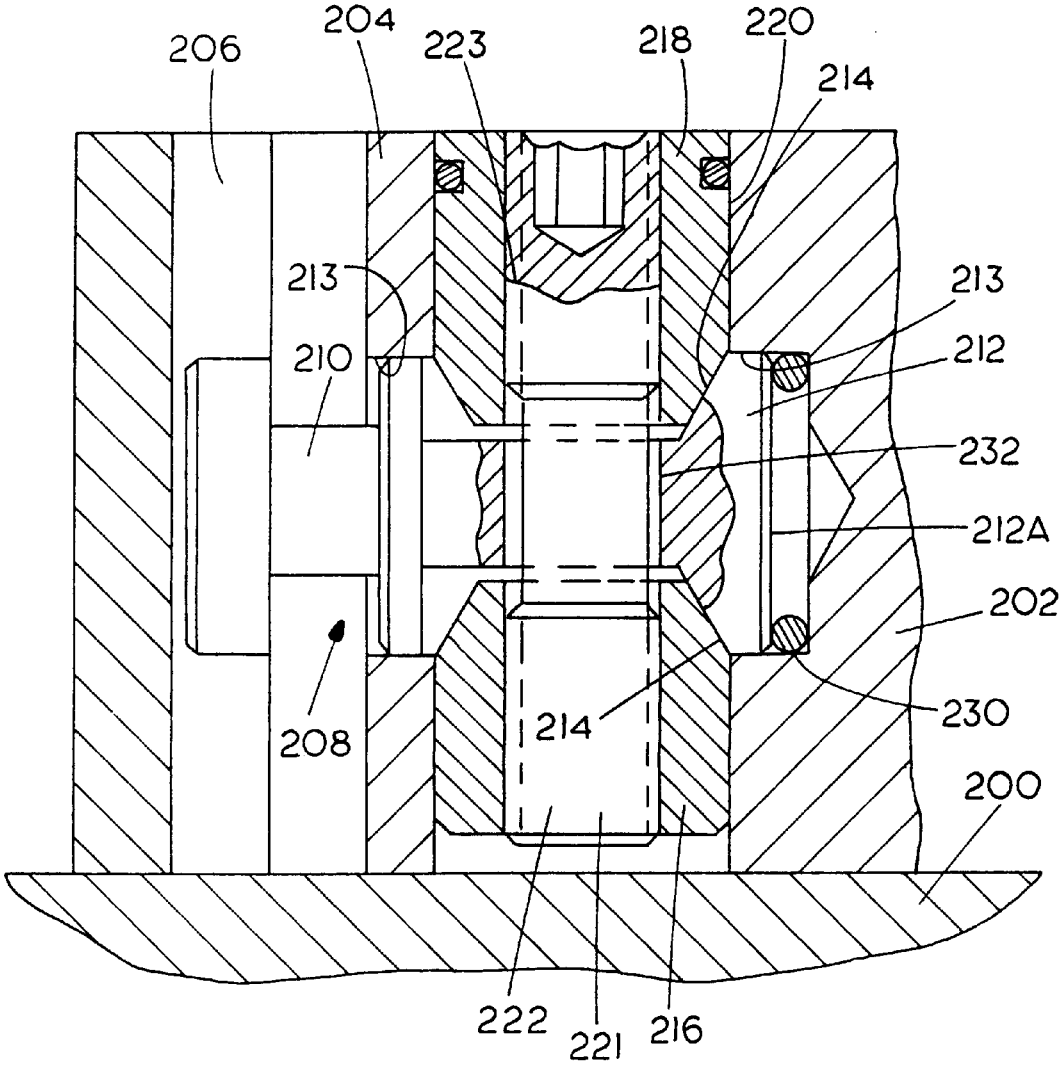
FIG. 17 is a sectional view of a modified wedge lock arrangement used with the present invention.

As shown, pull rods 183 that can be made according to any of the forms of the invention have heads that are positioned in "key hole" type T-slots 185, so that the slots do not have any openings at the edges or on the clamping surface. The keyhole slots are completely enclosed and within the periphery of the jaw plate 182. In FIG. 17, it can be seen that the slots have a large entry opening or receptacle 186, and these entry openings 186 are spaced apart the same distance as the pull rods 183 on the vice jaw 181. The openings or recesses 186 are sufficiently large so that the heads 187 of the pull rods 183 will slip into the openings, which are shown in FIG. 16, are recessed with a larger inner portion 188, and a slot 189 that extends laterally and opens to the larger portion 187 that receives the head.

The slot 189 is of size to receive the shank 190 of the pull rod between the main pull rod body and the head 183, and when the heads of the two pull rods are positioned in the recess 186, the jaw plate 182 can be slid sideways and the slots 189 will slide along the shanks 190 while the heads 187 remain trapped in the larger portions 187 of the slot. The larger portion 187 form blind holes, and they are milled out with a cutter and do not go to the edges of the jaw plate. The direction of the orientation of the slots 189 can be selected as desired and can be either vertical or horizontal, as shown.

To install the jaw plate 182, the pull rods are loosened so that the heads 187 are protruding sufficiently far from the jaw surface shown at 181A so that the mating surface of the jaw plate 182 can be rested against the surface 181A with the heads 187 and the shanks 190 in the openings or recesses 186. Then the jaw plate is merely slid laterally to the position shown in FIG. 16, and then the pull rods are tightened down with the wedge lock arrangements previously explained.

In FIG. 17, a modified form of the wedge lock arrangement is illustrated to show that the operation of the wedges can be in various forms. In this form of the invention, a vise body 200, which is the same as in the other forms of the invention, has a vise jaw 202 mounted thereon. The jaw 202 can be either a fixed jaw or movable jaw as desired. The jaw 202 is used to mount a removable jaw plate 204 thereon. The jaw plate has T-slots 206 that in this case are vertical as previously shown, and are held in place with a wedge lock pull rod assembly 208 that includes a pull rod 210 that has a round head formed as shown previously. The pull rod 210 extends into a bore 213 in the jaw and includes a wedge lock end 212 mounted in the inner end of bore 213 in the jaw. The wedge lock end 212 has oppositely facing wedge surfaces 214 on opposite sides thereof, and a pair of wedge lock members 216 and 218 are positioned in a cross bore 220 that intersects bore 213. The wedge lock members have wedge surfaces positioned to mate with the wedge surfaces 214. The lower wedge lock member 216 has a central bore with left-hand threads for receiving a double threaded stud 222.

The lower end 221 of the double threaded stud has lead hand threads, and the upper end 223 has right-hand threads, which mate with right-hand threads in a bore in the wedge lock member 218. The stud 222 extends through bore 232 in the central part of the pull rod 210 and threads into both wedge lock members.

When the stud 222 is turned in one direction, the right and left hand threads on the stud and in the respective wedge lock members will operate tc pull the two wedge lock members 216 and 218 together so they simultaneously act on the wedge surfaces 214. The wedge lock member thus forces the pull rod 210 farther into the bore 213, thus pulling the jaw plate 204 tightly against the surface of the jaw 202.

In this form of the invention, an elastic ring 230 is placed in the inner end of the bore 213, between the end surface 212A of the wedge lock end 212 and the end surface of bore 213. As the stud 222 is tightened by operating the lock members, the end surface 212A of the wedge lock end 212 will bear against the elastic ring 230 to compress the elastic ring against the end of the bore 213 and this will provide a releasing force on the pull rod. The releasing force is effective when the wedge lock members are loosened to release the pull rod 210 and the jaw plate.

The action of the double threads of opposite direction spiral move the pull rod 210 twice as fast as that shown in the previous forms of the invention, because both wedge members 216 and 218 are threaded toward the wedge surfaces 214 that they act upon. The power or force generated for the same torque on the threaded member is lessened.

It can be seen that other forms of the invention can also be utilized with wedge lock members on both sides of the pull rod.

By having wedge members on opposite sides of the pull rod and specifically on opposite sides of the wedge surfaces on the pull rod, the forces are balanced and there is no forces tending to urge the pull rod laterally toward one side of the bore 213 or the other.

The keyhole slot is a form of a T-slot that can be formed so the locking portion is vertical or perpendicular to the rail surfaces, as shown in the previous forms of the invention. The square head wedge lock pull rod will work with the keyhole, as well. Likewise, the horizontal or transverse slot shown in FIG. 13 can be used with a round head pull rod or wedge lock actuated fastener.

Figure 18:
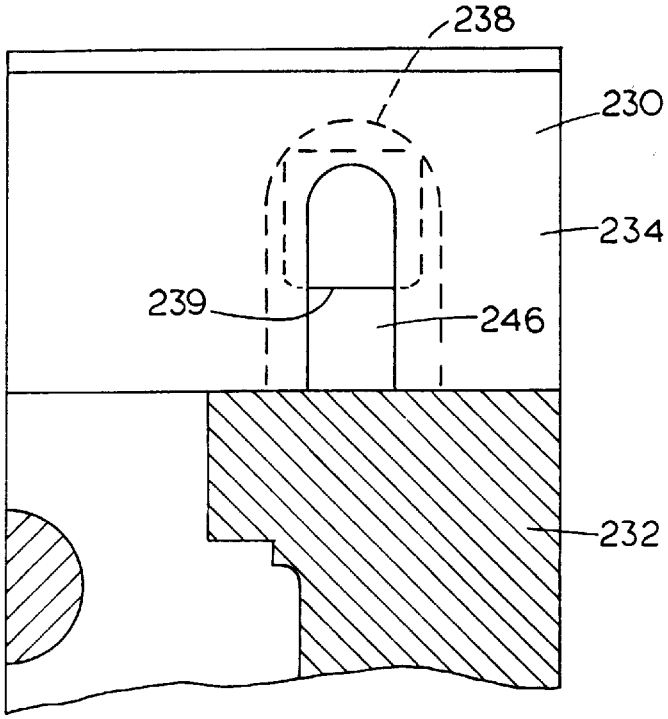
FIG. 18 is a front view of a modified reversible face jaw plate.
Figure 19:
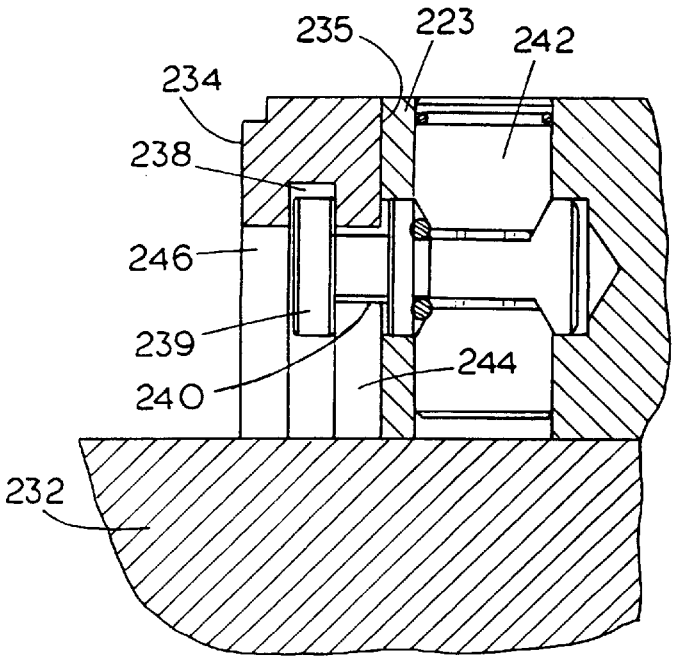
FIG. 19 is a sectional view taken on line 19—19 in FIG. 18.

In FIGS. 18 and 19, a further modified form of the jaw plate can be utilized with the wedge lock members, as illustrated. In this form of the invention, the jaw plate 230, shown fragmentarily about a center line, is mounted on a vise body 232 in a conventional manner. The jaw plate 230 is made so that it can be reversed or, in other words, both faces of the jaw plate can be utilized for clamping. In FIG. 18, a first face 234 is illustrated, and in FIG. 19, it can be seen that the second face 235 is against a jaw 236, mounted onto the vise body 232 in a normal manner. A double-sided slot arrangement is utilized. This includes a larger slot section 238 that is of size to receive a head 239 of a pull rod 240, that is slidably mounted in a bore in the jaw 223, as was previously shown. Wedge lock members 242 are used for actuating the pull rod in the usual manner to draw the jaw plate against the jaw.

Slot 238 has two narrower slot sections 244 and 246, through which a shank portion of the pull rod 240 extends. In the form shown the pull rod 210 extends through slot section 244 to pull the surface 235 against the jaw 223. The other narrow slot section 246 opens to the face 234. It is apparent that this jaw 230 can be reversed so face 234 is against the jaw. The head 239 is then slipped into the slot portion 238 with the pull rod 240 extending out of slot 246 so the jaw plate may be pulled so tighten face 234 against the jaw.

The pull rods can extend in either direction from the jaw plate so that either the face 235 or the face 234 can be pulled against the jaw 236. The wedge lock member 242 can be actuated as previously shown in the other forms of the invention. The jaw plate 230, thus, is provided with greater versatility and usability.

The wide slot section 238 with the narrow slot portions 244, 246 can be positioned as shown in the first form of the invention so that there are two such slots on a jaw plate, laterally spaced apart. A substitution of the slot configuration shown in FIGS. 18 and 19 for the slot configuration shown in FIGS. 4 and 5 will permit reversing the jaw plate and holding it securely during use.

The wedge lock actuators are recessed and substantially hidden. Only the cap screws or actuator studs are exposed to the exterior. The cap screws that act as part of the wedge lock actuator assembly can be tightened substantially so that there is not any looseness or play in the jaw plates. The advantages of the quick change jaw are available with all forms of the invention shown and can be used on moveable jaws, fixed jaws, and various types of clamps.

Although the present invention has been described with reference to preferred embodiments, workers skilled in the art will recognize that changes may be made in form and detail without departing from the spirit and scope of the invention.

What is claimed is:

1. A quick clamping member that engages a part to be clamped comprising in combination:

a jaw plate having a slot formed therein with a wide portion within the plate and a narrower neck leading from the wide portion to one surface of the jaw plate;

a wedge lock pull rod having a head portion fitting in said slot and having a shank extending through the narrower neck, and having a wedge lock portion at a second end thereof; and a wedge lock actuator actuable to engage the wedge lock portion for exerting a force to move the jaw plate in a longitudinal direction along the axis of the wedge lock pull rod so the one surface is pulled in a direction toward the second end of the wedge lock pull rod under action of the wedge lock actuator.

2. The quick change jaw plate of claim 1, wherein said wedge lock actuator is operated along an axis perpendicular to the axis of the wedge lock pull rod.

3. The quick change jaw plate of claim 1, wherein there is a second wedge lock pull rod adapted to be slidably mounted coaxially with the first mentioned wedge lock pull rod, said second wedge lock pull rod having a second wedge lock portion adjacent the wedge lock portion of the first mentioned wedge lock portion, and the wedge lock actuator having two wedge lock sections engaging both of the respective wedge lock portions simultaneously.

4. The quick change jaw plate of claim 2, wherein the wedge lock pull rod slidably fits into a main bore in a clamp jaw, and wherein said wedge lock actuator has two moveable wedge lock actuator sections positioned on opposite sides of the wedge lock pull rod in a cross bore perpendicular and open to the main bore, the wedge lock pull rod having two wedge lock portions facing in opposite directions in the cross bore and each movable into the main bore, and a force generating member to urge the two wedge lock portions together to simultaneously exert a wedge locking force on the wedge lock pull rod to pull the wedge lock pull rod in a direction to move a jaw plate against the clamp jaw.

5. The quick change jaw plate of claim 2, wherein the wedge lock actuator is used in combination with a clamp jaw having a main bore therein perpendicular to a jaw clamping face in which the wedge lock pull rod is slidable, a cross bore in the clamp jaw that intersects the main bore, and the wedge lock pull rod having a recess forming the wedge lock surface portion, the recess having a generally flat bottom surface, an opening through the wedge lock pull rod aligning with the cross bore, and the wedge lock actuator including a slidable member in the cross bore, the slidable member having an opening therethrough aligning with the opening in the wedge lock pull rod, a threaded fastener in the opening of the slidable member and extending through the opening in the wedge lock pull rod, said threaded fastener member being threaded to a threadable member on an opposite side of the wedge lock pull rod from the slidable member and being threadable to force the slidable member toward the wedge lock surface portion on the wedge lock pull rod.

6. The quick change jaw plate of claim 5, wherein the threadable member on the opposite side of the wedge lock pull rod relative to the slidable member comprises a second wedge lock actuator in the cross bore facing a second wedge lock surface of said wedge lock pull rod, which surface is also on the opposite side of the wedge lock pull rod relative to the position of the slidable member.

7. The quick change jaw plate of claim 1, wherein said wedge lock actuator comprises a slidable member having a central axis and having a tapered surface facing the recess forming the wedge lock surface portion of the wedge lock pull rod.

8. The quick change jaw plate of claim 3, wherein both of the wedge lock pull rods are mounted in a first bore in a clamp jaw with their wedge lock portions adjacent to each other in the first bore, a cross bore in such clamp jaw intersecting the first bore and opening to the wedge lock portions on both of the wedge lock pull rods, the wedge lock actuator comprising a slidable member in the cross bore, and the wedge lock portions comprising surfaces that face inwardly toward a central axis of the slidable member and which taper from outer edges of the slidable member toward the central axis.

9. The quick change jaw plate of claim 8, wherein said slidable member is a first slidable member and has a central opening therethrough, and the wedge lock portions of the wedge lock pull rods have part-cylindrical surfaces aligning with the opening in the slidable member, a threadable fastener passing through the opening in the slidable member and being received in the part-cylindrical recesses of the wedge lock portions of the wedge lock pull rods, and a second threaded member in the cross bore on an opposite side of the wedge lock portions from the first slidable member, said second slidable member being threaded to receive the threadable fastener and permit the threadable fastener to urge the first slidable member toward the wedge lock portions.

10. The quick change jaw plate of claim 1, wherein said slot in the jaw plate is positioned to extend substantially perpendicular to a plane of movement of the jaw plate as the jaw plate moves to a clamping position.

11. The quick change jaw plate of claim 1, wherein said slot in the jaw plate extends generally parallel to a plane of movement of the jaw plate as the jaw plate moves to a clamping position.

12. The quick change jaw plate of claim 1, wherein said wedge lock pull rod head portion has a generally rectilinear periphery.

13. A system for fixing a removable jaw plate to a jaw of a clamp comprising:

a wedge lock fastener mounted in a bore in the jaw and protruding from a face of the jaw, the fastener having a relatively larger diameter head region and a relatively smaller diameter first shank region, and having a wedge lock surface formed between a relatively larger diameter wedge lock end and a relatively smaller diameter second shank region positioned within a bore in the jaw;

a face plate defining a slot having a relatively larger portion and a narrow portion, said relatively larger portion receiving the fastener head and permitting the shank portion to pass outwardly from the slot through the narrow portion;

a wedge lock actuator comprising a slidable wedge lock actuator extending in a direction transverse to the wedge lock fastener, and being actuable toward and away from the wedge lock fastener, said wedge lock actuator engaging the wedge lock surface on the wedge lock fastener and urging the wedge lock fastener head region toward the jaw face when the wedge lock actuator is moved to an actuated position.

14. The system of claim 13, wherein the wedge lock actuator comprises two wedge lock actuator portions positioned on opposite sides of the wedge lock fastener in the bore, said wedge lock fastener having oppositely-facing wedge lock surfaces on opposite sides thereof, and the two wedge lock portions being urged together toward the fastener to simultaneously act against the two wedge lock portions of the fastener to urge the head region toward the jaw face.

15. The system of claim 13, wherein said wedge lock actuator has a second actuator surface, a guide collar on the wedge lock fastener positioned within the bore of the jaw adjacent to the second actuator surface, said second actuator surface facing the guide collar, and a resilient member engaged by the second actuator surface and reacting compression forces against the guide collar to provide a resilient force tending to urge the head region of the wedge lock fastener in a direction toward the face plate.

16. The system of claim 13, wherein the bore in the jaw comprises a first bore and wherein the wedge lock fastener slides into said first bore, said jaw having a transverse width along the face, and a height generally perpendicular to the transverse width, said first bore extending into the face having a closed end within the jaw, a cross bore extending generally through the height of the jaw and intersecting the first bore, the wedge lock actuator being slidable in the cross bore on a first side of the wedge lock fastener positioned in the first bore, the wedge lock surface being on a side of a central axis of the cross bore opposite from the face plate, said wedge lock surface comprising a tapered surface that tapers from an inner end of the wedge lock fastener more closely adjacent to the central axis of the cross bore than an outer end, and the slidable wedge lock actuator having a tapered surface facing the tapered surface on the wedge lock fastener, and a threaded fastener for urging the slidable wedge lock actuator inwardly in the cross bore to engage the wedge lock surface of the wedge lock fastener to exert a force on the wedge lock fastener drawing the relatively larger diameter head region toward the face of the jaw.

17. The system of claim 16, wherein said wedge lock fastener has an aperture therethrough generally centered on the axis of the cross bore, the slidable wedge lock actuator having an aperture therethrough of size to receive a cap screw that passes through the aperture of the wedge lock fastener, and a threaded reaction member on an opposite side of the wedge lock fastener from the slidable wedge lock actuator for receiving a threaded end of the cap screw whereby the cap screw can be tightened and the reaction member will react against the wedge lock fastener so that the slidable wedge lock actuator is forced toward the wedge lock fastener to move the wedge lock fastener.

18. The system of claim 17, wherein said wedge lock surface comprises a first wedge lock surface on the wedge lock fastener, and a second wedge lock surface on said wedge lock fastener facing in an opposite direction from the first wedge lock surface, said second wedge lock surface being open to the cross bore on a side of the wedge lock fastener opposite from the first slidable wedge lock actuator, said threaded fastener comprising a second slidable wedge lock actuator for engaging the second wedge lock surface on the wedge lock actuated fastener simultaneously with engagement of the first slidable wedge lock actuator with the first wedge lock surface.

19. A removable jaw plate for a jaw of a clamp, the clamp jaw having a face that engages a part to be clamped, having a tightenable headed fastener protruding from a face of the jaw, the removable jaw plate comprising a plate member seating against the clamp jaw face to substantially cover the jaw face, the jaw plate having a T-slot therein opening only to the side of the jaw plate seating against the clamp face, the headed fastener having a head portion in the T-slot and extending into the clamp jaw with a wedge lock surface formed on the end opposite the head portion, and a wedge shaped actuator for contacting the wedge lock surface of the headed fastener so that such contact moves the head portion toward the face of the jaw and urges the jaw plate against the face of the jaw.

20. The removable jaw plate of claim 19, wherein said actuator comprises a wedge lock member slidably mounted within the jaw and actuable from the exterior of the jaw and acting on a portion of the headed fastener positioned in a bore in the jaw for tightening the headed fastener.

21. The removable jaw plate of claim 20, wherein said portion of the headed fastener engaged by the wedge lock member comprises a wedge lock surface formed on the headed fastener accessible from the exterior of the jaw, a fastener and a wedge lock actuator engaging the wedge lock surface on the headed fastener and moveable toward the wedge lock surface of the headed fastener to provide force on the wedge lock surface to tighten the headed fastener.

22. The removable jaw plate of claim 19, wherein said headed fastener is slidably mounted in a first bore in the vise jaw, a cross bore intersecting the first bore, said headed fastener having a wedge-like wedge lock surface formed therein by a recessed portion and a tapered surface extending from the recessed portion to an exterior surface of the headed fastener, and a wedge lock actuator slidably mounted in said cross bore, including a member that forces the wedge lock actuator into engagement with the wedge lock surface on the headed fastener.

23. The removable jaw plate of claim 22, wherein there are two portions of the wedge lock actuator in the cross bore on opposite sides of the headed fastener, and a threaded stud having double acting sets of threads, one for threadably moving each portion of the actuator simultaneously toward and away from the threaded fastener.

* * * * *

UNITED STATES PATENT AND TRADEMARK OFFICE

CERTIFICATE OF CORRECTION

PATENT NO. : 6,022,010

DATED : February 8, 2000

INVENTOR(S) : Leon M. Bernstein

It is certified that error appears in the above-identified patent and that said Letters Patent is hereby corrected as shown below:

Claim 19, Col. 11, line 26, after "clamp", insert --jaw--.

Signed and Sealed this

First Day of May, 2001

*Attest:*

Nicholas P. Godici

NICHOLAS P. GODICI

*Attesting Officer*

*Acting Director of the United States Patent and Trademark Office*